US005601132A

United States Patent [19]

Goodman

[11] Patent Number: 5,601,132

[45] Date of Patent: Feb. 11, 1997

[54] VERTICAL BLINDS AND METHOD FOR MAKING THE SAME

[76] Inventor: Carolyn Goodman, 48 Farrwood Dr., Andover, Mass. 01810

[21] Appl. No.: 390,366

[22] Filed: Feb. 1, 1995

[51] Int. Cl.[6] ..... E06B 3/12

[52] U.S. Cl. ..... 160/236; 160/173

[58] Field of Search ..... 160/236, 168.1 V, 160/172 V, 173 V, 176.1 V, 178.1 V, 900, 405

[56] References Cited

U.S. PATENT DOCUMENTS

| | | | |
|---|---|---|---|
| 4,309,472 | 1/1982 | Gotting et al. . | |
| 4,519,435 | 5/1985 | Stier | 160/236 X |
| 4,597,429 | 7/1986 | Driessen | 160/236 |
| 4,773,958 | 9/1988 | Goodman | 160/236 X |
| 4,842,036 | 6/1989 | Goodman | 160/236 X |
| 4,884,615 | 12/1989 | Hsu | 160/236 |
| 4,930,562 | 6/1990 | Goodman | 160/236 |
| 5,263,529 | 11/1993 | Landis | 160/236 |
| 5,273,781 | 12/1993 | Shu . | |
| 5,303,760 | 4/1994 | Perez . | |
| 5,305,813 | 4/1994 | Poole | 160/236 |
| 5,320,155 | 6/1994 | Bressler | 160/236 X |

*Primary Examiner*—David M. Purol
*Attorney, Agent, or Firm*—Davis and Bujold

[57] ABSTRACT

The invention provides vertical blinds that can be manufactured with fabric suitable for making clothing or drapery. The fabric is attached to a backing member through either by sewing the backing member in place or a heat process. If heating is used, the heat must not be excessive so that the fused fabrics are scorched. Once the backing member is attached to the fabric, the vertical blind is cut to the desired width and length. A weight is sewn or otherwise attached to a bottom portion of the vertical blind and a plastic insert is sewn or otherwise attached to a top portion of the vertical blind. The plastic insert is used to attach the vertical blind to a vertical blind support. Finally, a glue like substance, which prevents fraying of the fabric, is applied to the longitudinal edge portions of the vertical blind to ensure that fraying will not occur. This glue like substance can be applied with a brush, roller, or any other suitable dispenser that adequately applies the substance to the desired location of the fabric.

20 Claims, 3 Drawing Sheets

VERTICAL BLINDS AND METHOD FOR MAKING THE SAME

This invention relates to a vertical blind made from ordinary pliable fabric. In particular, though not exclusively, the vertical blinds are made from soft, pliable fabric or drapery material, supported by or fused to a backing material to stiffen the fabric and the blind is then sealed along the longitudinal edges to prevent fraying of the fabric.

BACKGROUND OF THE INVENTION

Prior art vertical blinds and drapery do not consist of only soft, pliable, ordinary fabric. For example, some vertical blinds use a vinyl or an aluminum backing member which is inherently stiff and does not fray. However, such vertical blinds are of limited usefulness as their decorating appearance is unacceptable in many instances.

Another type of vertical blind is disclosed in U.S. Pat. No. 5,273,781 to Shu. This vertical blind is produced by dipping a fabric into a stiffening compound. A couple of problems associated with dipping the complete fabric is that the entire surface becomes excessively hard and/or stiff and, in the inventor's experience, only solid color fabrics may be dipped—the color of patterned fabrics will generally "run" or spread in an undesired manner.

Another type of vertical blind comprises a fabric laminated to aluminum or some other similar rigid support surface. One disadvantage with this design is that the resulting blind tends to be overly stiff which, in turn, affects the blind's appearance. In addition, this blind is expensive to produce and, if a variation in the width of the blind is desired, this is difficult and expensive to achieve because the aluminum or other rigid backing member also must be cut along with the fabric.

Another drapery technique is to use a plastic backing member and a pair of edging members for each vertical blind strip. Presumably, any type of fabric may be used in this technique, however, the resulting blind is still overly stiff and the plastic edgings are visible. Both of these disadvantages detract from the general acceptability of blinds made in accordance with this technique.

Finally, vertical blinds of the type disclosed in U.S. Pat. No. 5,303,760 to Perez employ a fabric covering over existing vertical blinds. Again, as with the above discussed prior art designs, the resulting blind tends to be overly stiff and bulky thereby detracting from its appearance and acceptability.

OBJECTS OF THE INVENTION

Wherefore, It is an object of the present invention to overcome the aforementioned problems and drawbacks associated with the prior art designs.

Accordingly, it is an objective of the present invention to provide a vertical blind made from ordinary soft, supple, pliable fabric, either a single color or a multitude of colors having any desired pattern thereon.

A further object of the invention is to provide a backing member for the fabric which provides sufficient stiffness, so as to prevent the blind from losing its shape, while not excessively stiffening the blind so that its appearance remains acceptable.

Another objective of the invention is to seal only the longitudinal edge portions of the fabric forming the blinds so as to prevent fraying of the fabric therealong.

A further objective of the invention is to have a vertical blind that can be dry cleaned or can be washed through a normal washing cycle, depending upon the type of fabric used in the blinds.

Yet another objective of the present invention is to provide a vertical blind in which the length and/or width of the blinds can be easily selected and/or varied, e.g. narrowed or shorten, during the blind manufacturing process, or after manufacture.

Still another object of the invention is to provide a vertical blind in which the appearance of the front and rear surfaces of the blind, depending upon the application, can be similar or different from one another to assist with decorating the interior of a house or other building.

A further object of the invention is to provide a fused laminate or multilayer product which is formed from a first fabric layer and an intermediate backing material, the fused multilayer product being of sufficient size and dimensions to allow the plurality of individual vertical blinds to be produced therefrom. A second fabric layer can be attached to a second opposed surface of the backing material, if desired.

These and other objects of the invention will be better understood with reference to the following description and appended drawings.

SUMMARY OF THE INVENTION

According to the invention there is provided a fused multilayer vertical blind (1) comprising a pliable backing member (7); a first fabric (6) being attached to a first surface of said backing member and a second fabric (6') being attached to a second opposed surface of said backing member to provide a sturdy yet pliable and supple blind; and a fray stopping substance (9) being applied only along the longitudinal edge portions of said blind to prevent undesired fraying of said fabric therealong.

According to the invention there is also provided a kit of parts for making a laminated vertical blind (1), said kit of parts comprising a pliable backing member (7) being dimensioned to produce a plurality of vertical blinds; a first fabric (6) being dimensioned to produce a plurality of vertical blinds; a second fabric (6') being dimensioned to produce a plurality of vertical blinds; said first fabric (6) which, when secured to a first surface of said backing member (7), and said second fabric (6') which, when secured to a second opposed surface of said backing member, produces a sturdy yet supple and pliable fused multilayer vertical; and a fray stopping substance (9) which, when applied to only the longitudinal edges of each individual vertical blind cut from said fused multilayer vertical blind, prevents undesired fraying of said fabrics therealong.

According to the invention there is also provided a method of making a vertical blind (1) from a fused multilayer product, said method comprising the steps of a) providing a pliable backing member (7) and a first fabric (6) which are each dimensioned to produce a plurality of vertical blinds therefrom; b) placing said first fabric (6) adjacent a first surface of said backing member (7) thereby to form a fused multilayer vertical blind; and c) cutting said fused multilayer vertical blind into a plurality of individual vertical blinds (1) with each said individual vertical blind (1) having a desired length and width dimension.

BRIEF DESCRIPTION TO THE DRAWINGS

The invention will now be described, by way of example, with reference to the accompanying drawings, in which.

DETAILED DESCRIPTION OF THE INVENTION

Figure 1:
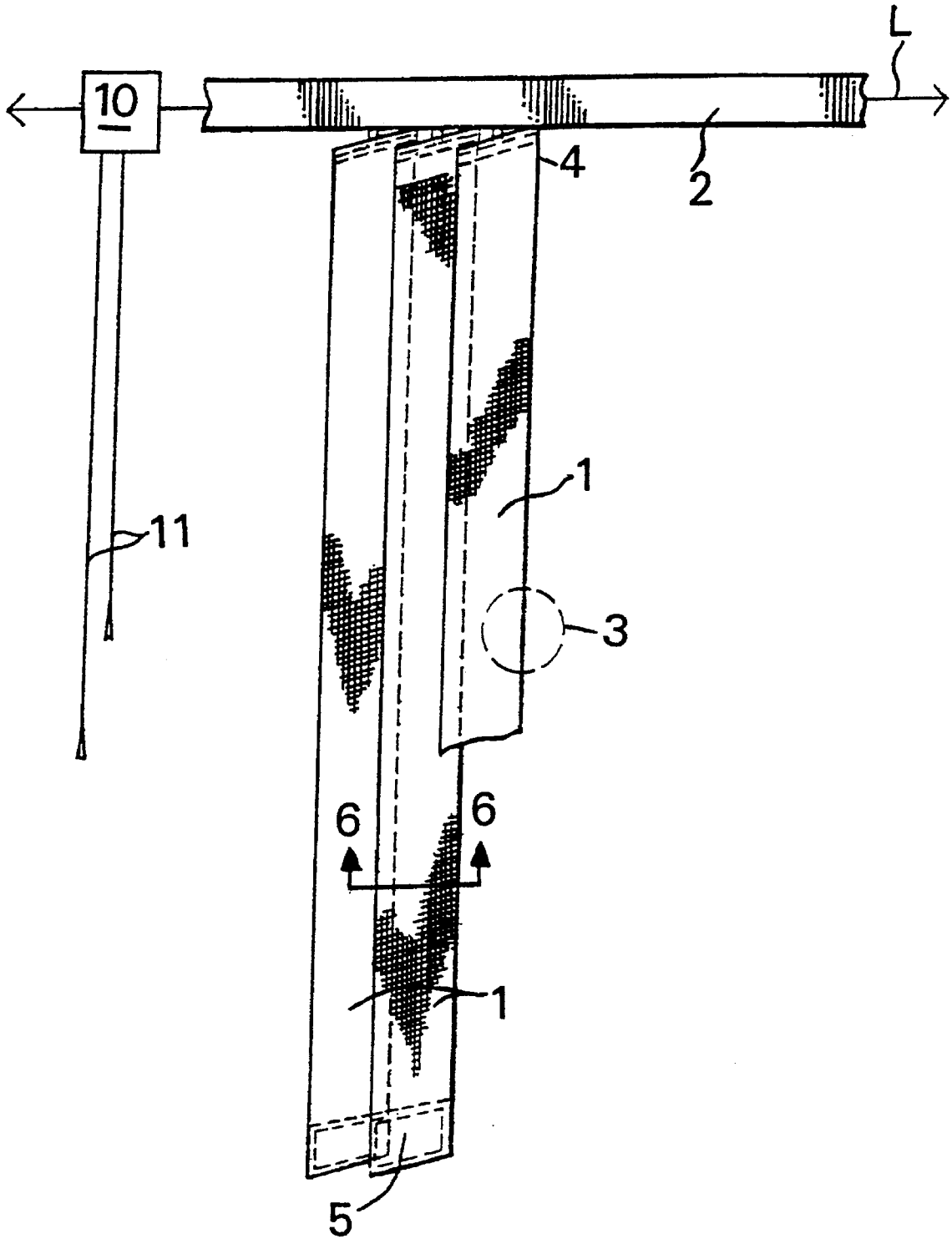
FIG. 1 is a partial perspective view of three (3) vertical blinds attached to a blind support.

Turning first to FIG. 1, there is shown a partial perspective view of a plurality of vertical blinds 1 (only three (3) of which are shown for the sake of clarity) suspended from a vertical blind rod or support 2, which typically includes an exterior housing. A rear or side surface of the housing is, in turn, secured in place by a plurality of fasteners (not shown), such as screws, to a desired surface, e.g. a wall or ceiling. A plastic insert 4 is used to connect each vertical blind 1 to a control mechanism, designated generally as element 10, associated with the blind support 2 so that the vertical blinds can be "opened", e.g. all of the vertical blinds rotated about their longitudinal axis to be positioned substantially perpendicular to a longitudinal axis L of the blind support 2, and "closed", e.g. all of the vertical blinds rotated about their longitudinal axis to be positioned substantially parallel to the longitudinal axis L of the blind support 2. In addition, a conveying mechanism, associated with the control mechanism 10, allows all of the vertical blinds 1 to be conveyed, via operation of a pair of strings or the like 11, to at least one end region of the blind support 2, e.g. to the left as can be seen in FIG. 1, so that the vertical blinds 1 do not obstruct a substantial portion of the area underneath the blind support 2. As the blind support 2 and the control and conveying mechanisms 10, 11 are well known in this art and do not form any part of the present invention, a further detailed description concerning the same is not provided herein.

The plastic insert 4 extends along only a top edge portion of each vertical blind 1 rather than from the top to the bottom. As such, the plastic insert 4 does not serve as a surface onto which the vertical blind 1 is fused but rather as an attachment member for connecting the vertical blind 1 to the blind support 2. At a bottom opposite end of the vertical blind 1, a weight 5 is sewn or otherwise attached into the vertical blind 1 so as to keep the vertical blind 1 hanging substantially straight, i.e. substantially vertical.

Figure 2:
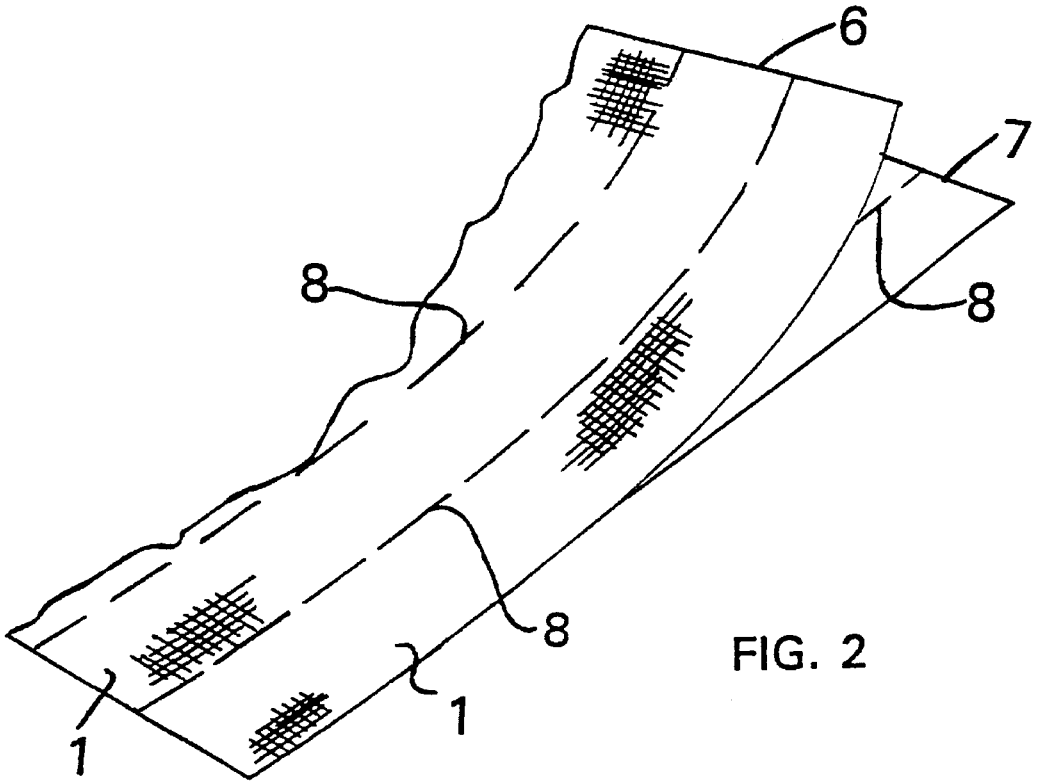
FIG. 2 is a partial perspective view of the vertical blind fabric being adhered to a backing member.
Figure 4:
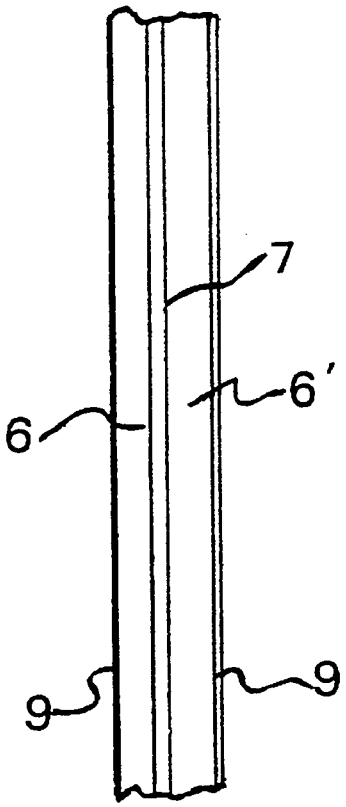
FIG. 4 is an enlarged partial diagrammatic side view of a longitudinal edge of one of the vertical blinds shown in FIG. 1.
Figure 5:
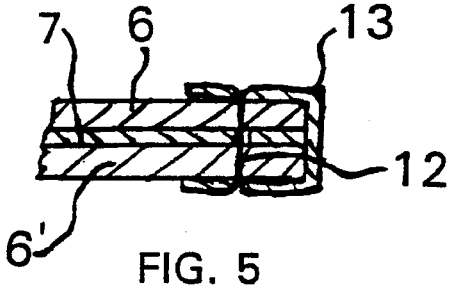
FIG. 5 is an enlarged partial diagrammatic cross-sectional view, along a longitudinal edge of a sewn seam, showing a second embodiment of a vertical blind according to FIG. 1.

Turning now to FIG. 2, the process for manufacturing a vertical blind 1, according to the present invention, will now be discussed in detail. Ordinary fabric 6, such as that used for making other clothing and drapery items, is used to create the vertical blind 1 according to the present invention. The fabric 6 is bonded to a first surface of a backing fabric or member 7 by heating at least one of the fabric 6 and the backing member 7 until a sufficient bond or fusion between those two components has occurred. When heating these components to integrally interconnect and/or join the fabric 6 to the backing member 7, it is important that the heat not be too severe so as scorch the surface, i.e. the fused multilayer product must remain supple. Typically, a standard household iron on medium setting would be sufficient to create a soft and pliable yet sturdy vertical blind 1, e.g. a temperature of about 51.6° C. to about 79.4° C. (125° F. to about 175° F.) is employed. The necessary temperature of the iron is dictated by the type or kind of the fabric and the type or kind of backing material. In some applications, a second fabric 6' (FIGS. 4–6) is bonded to a second opposed surface of the backing member 7. It is to be appreciated that the first and second fabrics 6, 6' can be identical to one another or they can be different from one another, depending upon the application. In addition, one or both of the fabrics could contain a mural or some other depiction so that when the blinds are properly arranged and rotated to their closed position, the mural or other depiction can be readily seen and use as an interior or an exterior decoration.

The backing member 7 is preferably a fusible interfacing, such as PELLON brand interfacing from Pellon Manufacturing, Chelmsford, Mass. for example, however, many other similar backing members may be utilized. The backing member should be sufficiently thin and flexible so that it is readily cut with scissors. In addition, it is also to be appreciated that the backing member 7 may be attached to the fabric 6 by sewing, gluing, or some other known attachment means. The advantage of sewing the backing member 7 to the fabric 6 is that a seam 12 (FIG. 5) used to sew these components together can comprise a variety of different stitching patterns which add to the overall aesthetics of the vertical blind 1. The stitching step generally follows the cutting step. Alternatively, an edge decoration, such as lacing or some other trim material 13, can be attached along the longitudinal edges of the backing member 7 and the fabric 6, 6'. The trim material can either: 1) completely cover the side wall located between the two adjacent longitudinal edges of the blind as well as a portion of the front and rear surfaces of the blind (FIG. 5), only cover a longitudinal edge portion(s) along a front surface of the vertical blind (not shown), or cover the longitudinal edge portion(s) along two opposed surfaces of the vertical blind (not shown). Once the fabric 6, 6' is bonded or attached to the backing member 7 to form a laminate or fused multilayer product thereof, the resulting fused multilayer product is then cut into a plurality of strips having a desired width and length. In accordance with the teaching of the present invention, a custom made vertical blind 1 of essentially any width or length can be readily achieved.

As can be seen in FIG. 2, a cut along cut lines 8 would produce typical width vertical blinds 1. The fabric 6 may or may not, depending upon the application, have dashed lines 8 imprinted on the fabric. However, if dashed lines 8 are imprinted on the fabric, this will assist a user with making the vertical blinds at home. Alternatively, the backing member 7 may have a plurality of cut lines 8 imprinted thereon so that a user may know exactly where to cut the blinds for purposes of creating properly sized and/or dimensioned vertical blinds. After cutting the vertical blinds to the proper size, the plastic insert 4 is sewn or otherwise attached to the top edge portion of the blind while the weight 5 is sewn or otherwise attached to the bottom edge portion of the vertical blind, as described with reference to FIG. 1.

Figure 3:
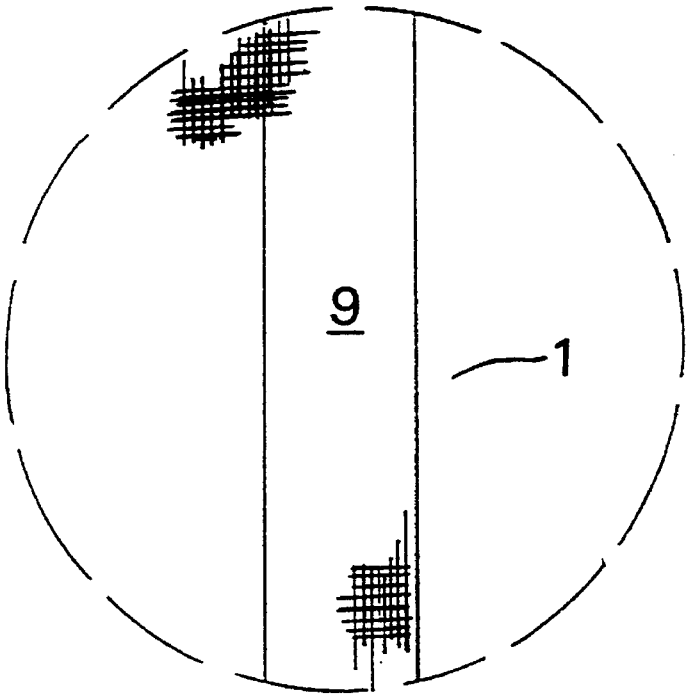
FIG. 3 is an enlarged partial view of an edge portion of the vertical blind depicted by the circle 3 shown in FIG. 1.

Referring now to FIG. 3, an enlarged view of a longitudinal edge of the vertical blind 1, as can be seen in FIG. 1, is shown. A clear liquid fray stopping material or substance 9 is applied along both edges and/or sides of the entire longitudinal edges of the vertical blinds 1. It is not necessary, and generally undesirable, to apply the fray stopping substance 9 over the entire surface of the vertical blind 1, e.g.

typically the fray stopping substance 9 is only applied along about 1/16 to 1/4 inch (1.59 to 6.35 mm) wide strip along the longitudinal edge portion of the blind. The fray stopping substance 9 is typically a glue like substance such as DRITZ FRAY CHECK, from Dritz Corporation, Spartanburg, S.C. for example, which seals the edge portions of the vertical blinds to prevent any exposed threads of the fabric from becoming unravelled or otherwise fraying. The fray stopping substance 9 is selected so that it does not unduly stiffen the vertical blind 1 or detract from the overall appearance of the blind. Typically, the fray stopping substance 9 is applied to at least the two longitudinal edges of the vertical blind 1, but it may also be applied, if desired, along any stitching of the blinds, e.g. along the stitching for the plastic inserts 4 and the weights 5.

The fray stopping substance 9 can be applied with a brush, a roller, or an other desired applicator suitable for applying the fray stopping substance 9 along the desired areas of the vertical blind 1. Once the fray stopping substance 9 is applied to the vertical blind 1, a drying period of about six (6) hours is required to completely dry and/or cure the fray stopping substance 9. Following the drying period, the vertical blind 1 is then ready to be hung or otherwise utilized.

The fray stopping substance 9 is preferably a clear substance so that it is not readily seen. However, in some applications, it may be desired to use a colored fray stopping substance to assist with the aesthetic appearance of the blind.

Figure 6:
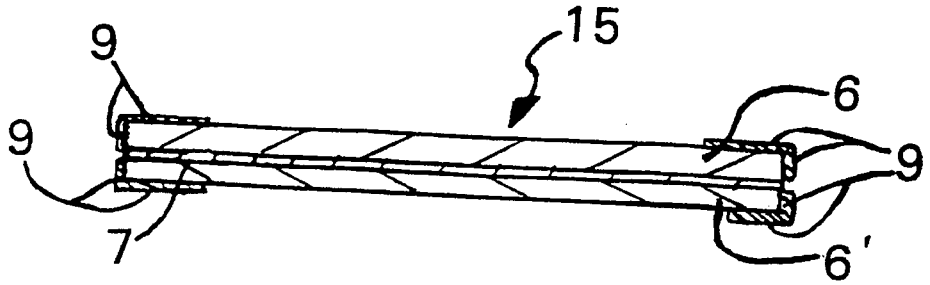
FIG. 6 is a diagrammatic cross-sectional view of one of the vertical blinds along section line 6—6 of FIG. 1.

Turning now to FIG. 6, a cross-sectional view of a vertical blind, according to the present invention, can be seen. As is apparent from this view, typically three separate materials, i.e. two fabrics and one interfacing, form the fused multilayer product or laminate 15 and all three layers are substantially planar members. In addition, as each individual vertical blind is cut from a larger fused multilayer product 15, all three layers forming each individual vertical blind have the same identical dimensions, i.e. fabric(s) 6, 6' and the backing member 7 extend to and forms part of the side wall defining the longitudinal edge of each individual blind.

It is readily apparent that there are a number of significant advantages in this invention. First, most types of fabrics, including fabric with design patterns, may be used. Second, the resulting vertical blind 1 has a supple surface that retains its shape. Third, the vertical blinds manufactured according to the present invention are generally sufficiently porous and flexible so that they may be dry cleaned, if desired. Fourth, since the fray stopping substance is applied to the vertical blind 1, the blinds will not fray. Fifth, it is easy to vary the width and/or length because there would be few items to alter and because potential fabric curling is not a concern if this technique is employed. Finally, the resulting vertical blind is less expensive to manufacture than blinds made from other processes, particularly those requiring some form of fusion to a hard backing support, and is well suited for purchase in kit form and manufacture at home by an average do-it-your-self person.

Since certain changes may be made in the above described vertical blind, without departing from the spirit and scope of the invention herein involved, it is intended that all matter contained in the above description or shown in the accompanying drawings shall be interpreted merely as examples illustrating the inventive concept herein and shall not be construed as limiting the invention.

What is claimed is:

1. A fused multilayer vertical blind (1) comprising:

a pliable backing member (7);

a first fabric (6) being attached to a first surface of said backing member to provide a sturdy yet pliable and supple blind; and a fray stopping material being applied at least along exposed outwardly facing longitudinal edge portions of at least said first fabric (6) to prevent undesired fraying of said fabric therealong.

2. The vertical blind (1) according to claim 1 wherein the fray stopping material is a liquid, a second fabric (6') is attached to a second opposed surface of said backing member, said backing member (7) is interfacing, and said liquid fray stopping material is applied at least along exposed outwardly facing longitudinal edge portions of said second fabric (6') to prevent undesired fraying thereof.

3. The vertical blind (1) according to claim 2 wherein said interfacing is adhered to said first and second fabrics (6) by application of heat;

said first and second fabrics (6, 6') each defining a front surface containing a desired pattern, a backing surface for engaging with said interfacing, and a pair of longitudinal side surfaces; and said liquid fray stopping material is also applied along each of said longitudinal side surfaces of said first and second fabrics (6, 6').

4. The vertical blind (1) according to claim 1 wherein said backing member (7) is attached to at least said first fabric (6) by stitching.

5. The vertical blind (1) according to claim 1 wherein a weight (5) is attached to a bottom portion of said vertical blind (1).

6. The vertical blind according to claim 1 wherein an insert (4) is attached to a top portion of said vertical blind (1) for attaching said vertical blind to a blind support (2).

7. A kit of parts for making a fused multilayer vertical blind (1), said kit of parts comprising:

a pliable backing member (7) being dimensioned to produce a plurality of vertical blinds;

a first fabric (6) being dimensioned to produce a plurality of vertical blinds;

said first fabric (6) which, when secured to a first surface of said backing member (7), produces a sturdy yet supple and pliable vertical blind laminate; and a fray stopping material which, when applied at least along exposed outwardly facing longitudinal edge portions of each individual vertical blind cut from said fused multilayer vertical blind, prevents undesired fraying of said fabrics therealong.

8. The kit according to claim 7 further including a second fabric (6') dimensioned to produce a plurality of vertical blinds and said second fabric (6'), when secured to a second opposed surface of said backing member, forming part of said fused multilayer vertical blind;

wherein the fray stopping material is a liquid, said backing member (7) is interfacing, and said liquid fray stopping material is applied at least along exposed outwardly facing longitudinal edge portions of said second fabric (6') to prevent undesired fraying thereof.

9. The kit according to claim 8 wherein said interfacing is adhered to said first and second fabrics (6, 6') by application of heat;

said first and second fabrics (6, 6') each defining a front surface containing a desired pattern, a backing surface for engaging with said interfacing, and a pair of longitudinal side surfaces; and said liquid fray stopping material is also applied along each of said longitudinal side surfaces of said first and second fabrics (6, 6').

10. The kit according to claim 7 wherein said backing member (7) is attached to at least said first fabric (6) by stitching.

11. The kit according to claim 8 further comprising a weight (5) which, when attached to a bottom portion of said vertical blind (1) allows said vertical blind (1) to hang vertically, and an insert (4) which, when attached to a top portion of said vertical blind (1), allows attachment of the vertical blind to a blind support (2).

12. The kit according to claim 10 further comprising a trim member for attachment to each longitudinal edge of said vertical blind.

13. The kit according to claim 8 wherein at least one of said first and second fabrics (6, 6') has a plurality of cut lines (8) imprinted thereon for use as a guide to cut said fused multilayer vertical blind into a plurality of individual vertical blinds (1) of desired dimensions.

14. The kit according to claim 7 wherein said backing (7) has a plurality of cut lines (8) imprinted thereon for use as a guide to cut said fused multilayer vertical blind laminate into a plurality of individual vertical blinds (1) of desired dimensions.

15. A method of making a vertical blind (1) from a fused multilayer product, said method comprising the steps of:

a) providing a pliable backing member (7) and a first fabric (6) which are each dimensioned to produce a plurality of vertical blinds therefrom;

b) placing said first fabric (6) adjacent and on top of a first surface of said backing member (7) and fusing first fabric (6) to the first surface of said backing member (7) thereby to form a fused multilayer vertical blind;

c) cutting said fused multilayer vertical blind into a plurality of individual vertical blinds (1) with having a desired length and width dimension and each said individual vertical blind (1) being substantially identical to one another; and d) applying a fray stopping substance (9) at least along exposed outwardly facing longitudinal edge portions of at least said first fabric (6) of each said vertical blind (1) to prevent undesired fraying of said fabric therealong.

16. The method according to claim 15 further comprising the steps of:

a) providing a second fabric (6');

b) placing said second fabric (6') in an overlapped arrangement adjacent a second opposed surface of said backing member (7) and fusing second fabric (6') to the second opposed surface of said backing member (7) prior to the cutting step; and c) applying said fray stopping substance (9), in liquid form, along at least the exposed outwardly facing longitudinal edge portions of each said vertical blind (1) to prevent undesired fraying of said fabric therealong.

17. The method according to claim 16 wherein said securing step further comprises the steps of using an interfacing as said backing member and heating said interfacing to adhere said first and second fabrics (6, 6') to said interfacing, and said first and second fabrics (6, 6') each define a front surface containing a desired pattern, a backing surface for engaging with said interfacing, and a pair of longitudinal side surfaces; and applying said liquid fray stopping material also along each of said longitudinal side surfaces of said first and second fabrics (6, 6').

18. The method according to claim 15 further comprising the steps of securing said backing member (7) to said first fabric (6) by sewing along longitudinal edges of the vertical blinds once said plurality of individual vertical blinds (1), of a desired length and width dimension, have been cut from said fused multilayer vertical blind.

19. The method according to claim 15 further comprising the step of attaching a weight (5) to a bottom portion of each said vertical blind (1).

20. The method according to claim 15 further comprising the step of attaching an insert (4) to a top portion of each said vertical blind (1).

* * * * *